US008686824B2

(12) United States Patent
Levin et al.

(10) Patent No.: US 8,686,824 B2
(45) Date of Patent: Apr. 1, 2014

(54) ECONOMICAL CORE DESIGN FOR ELECTROMAGNETIC DEVICES

(75) Inventors: Michael Levin, Toronto (CA); Andrii Valentyn Lavreniuk, Toronto (CA)

(73) Assignee: Mirus International Inc., Ontario (CA)

( * ) Notice: Subject to any disclaimer, the term of this patent is extended or adjusted under 35 U.S.C. 154(b) by 575 days.

(21) Appl. No.: 12/883,310

(22) Filed: Sep. 16, 2010

(65) Prior Publication Data

US 2012/0068805 A1 Mar. 22, 2012

(51) Int. Cl.
*H01F 27/24* (2006.01)
*H01F 17/04* (2006.01)

(52) U.S. Cl.
USPC ..... 336/216; 336/212; 336/217; 336/218; 336/221

(58) Field of Classification Search
USPC ..... 336/212, 216–218, 234
See application file for complete search history.

(56) References Cited

U.S. PATENT DOCUMENTS

| | | | | | |
|---|---|---|---|---|---|
| 2,300,964 | A * | 11/1942 | Putman | 336/217 |
| 2,647,575 | A * | 8/1953 | Patterson | 83/679 |
| 2,989,712 | A * | 6/1961 | Krabbe | 336/217 |
| 3,129,377 | A * | 4/1964 | Monroe et al. | 363/154 |
| 3,157,850 | A * | 11/1964 | Winter et al. | 336/216 |
| 3,169,236 | A * | 2/1965 | McQuade | 336/218 |
| 3,183,461 | A * | 5/1965 | Tipton | 336/60 |
| 3,200,358 | A * | 8/1965 | Neydli | 336/217 |
| 3,457,635 | A * | 7/1969 | Michiulis | 29/609 |
| 4,520,556 | A * | 6/1985 | Pasko et al. | 29/606 |
| 5,371,486 | A * | 12/1994 | Yamada et al. | 336/212 |
| 5,777,537 | A * | 7/1998 | Allen et al. | 336/96 |
| 6,100,783 | A * | 8/2000 | Hopkinson et al. | 336/216 |
| 2006/0226947 | A1 * | 10/2006 | Pauley et al. | 336/234 |

* cited by examiner

*Primary Examiner* — Elvin G Enad
*Assistant Examiner* — Ronald Hinson
(74) *Attorney, Agent, or Firm* — Christopher L. Parmelee; Walker & Jocke

(57) ABSTRACT

A magnetic core for an electromagnetic device is formed from alternating interleaved steel laminations. The core comprises a plurality of core elements comprising legs and yokes oriented substantially quadrature to the legs, such that abutting core elements are in substantially quadrature relation. A plurality of flux deflection zones are defined in regions where flux flows from one core element to an abutting core element. At least one of the layers has at least one core element composed of grain-oriented steel, and the remaining core elements are composed of non-grain-oriented steel, such that at least some flux deflection zones are composed of a substantial amount or substantially entirely of non-grain-oriented steel. Flux flowing in the direction of the grain orientation in the core element(s) composed of grain-oriented steel changes direction to flow through the abutting core element in the flux deflection zone composed of non-grain-oriented steel. This reduces the power losses in flux deflection zones of the core relative to cores formed entirely from grain-oriented steel, because the flux is never flowing perpendicular to the direction of the grains in the steel, while providing a design that is considerably less expensive than cores formed from non-grain-oriented steel with substantially the same level of power losses or lower.

20 Claims, 9 Drawing Sheets

60

70

ECONOMICAL CORE DESIGN FOR ELECTROMAGNETIC DEVICES

FIELD OF THE INVENTION

This invention relates to electromagnetic devices. In particular, this invention relates to electromagnetic devices with laminated steel cores.

BACKGROUND OF THE INVENTION

Electromagnetic devices such as various kinds of transformers and reactors are widely used in power supply and distribution systems. Reduction of their cost and/or power losses can significantly improve the economic parameters of such power systems.

In electromagnetic devices, power losses in the windings are directly proportional to the square of the loading of the winding. Therefore, power losses in a winding are much lower under low load conditions than under heavy load conditions. To the contrary, power losses in the core of an electromagnetic device having a ferrous core are independent of the load, and therefore power losses do not change significantly as long as the device is connected to the power system. This can be costly, because in many applications the devices are always connected to the power system regardless of whether there is load on them or not.

Conventional methods for reducing losses in a ferrous core have involved the use of higher quality steel for the core. For example, a major advancement in core losses reduction was the introduction of cold rolled grain-oriented steel. Grain-oriented steel has a polycrystalline structure, which provides high permeability and low energy dissipation (power losses) when the magnetic field flows in the direction of the grains.

However, there are two main drawbacks in the use of the grain-oriented steel. The cost of grain-oriented steel is substantially higher than the cost of non-grain-oriented steel; and the power loss in grain-oriented steel is substantially higher when the flux is flowing perpendicular (quadrature) to the direction of the grains than when the flux is flowing in the direction of the grains. As a result, a relatively high power loss is concentrated in the corners of a ferromagnetic core where the flux direction changes and crosses the grain orientation, as illustrated schematically in FIG. 2. The higher the grade of the grain-oriented steel, the higher is the difference between the power losses with flux flowing along the grain orientation versus across the grain orientation.

In order to reduce such power losses in the corners of grain-oriented steel cores, the prior art employed different core configurations such as mitered cores and wound distributed-gap cores. The use of a mitered core allows for some reduction of corner losses, but at significantly greater expense than a conventional grain-oriented steel core. A wound core is even more expensive than a mitered core, and in general for multi-phase devices does not result in any substantial reduction of power losses in the core.

The highest level of core losses reduction is achieved through use of amorphous steel for the core. However, the cost of amorphous steel is extremely high, and as such this core design option is not widely used.

BRIEF DESCRIPTION OF THE DRAWINGS

In drawings which illustrate by way of example only a preferred embodiment of the invention.

DETAILED DESCRIPTION OF THE INVENTION

The invention provides, for an electromagnetic device, a magnetic core formed from steel laminations, comprising a plurality of core elements, comprising at least two legs, at least two yokes, the yokes being oriented substantially quadrature to the legs, such that abutting core elements are in substantially quadrature relation, a plurality of flux deflection zones defined in regions where flux flows from one core element to an abutting core element, the core elements being formed from alternating interleaved layers, at least one of the layers comprising at least one core element composed of grain-oriented steel, and the remaining core elements being composed of non-grain-oriented steel, such that a plurality of flux deflection zones are composed of a substantial amount or substantially entirely of non-grain-oriented steel, whereby flux flowing in a direction of a grain orientation in the at least one core element composed of grain-oriented steel changes direction to flow through the abutting core element in the flux deflection zone composed of non-grain-oriented steel.

The invention further provides an electromagnetic device, comprising a magnetic core formed from steel laminations, and at least one winding wound over the core, the magnetic core comprising a plurality of core elements comprising at least two legs, at least two yokes, the yokes being oriented substantially quadrature to the legs, such that abutting core elements are in substantially quadrature relation, a plurality of flux deflection zones defined in regions where flux flows from one core element to an abutting core element, the core elements being formed from alternating interleaved layers, at least one of the layers comprising at least one core element composed of grain-oriented steel, and the remaining core elements being composed of non-grain-oriented steel, such that a plurality of flux deflection zones are composed of a substantial amount or substantially entirely of non-grain-oriented steel, whereby flux flowing in a direction of a grain orientation in the at least one core element composed of grain-oriented steel changes direction to flow through the abutting core element in the flux deflection zone composed of non-grain-oriented steel.

Figure 1A:
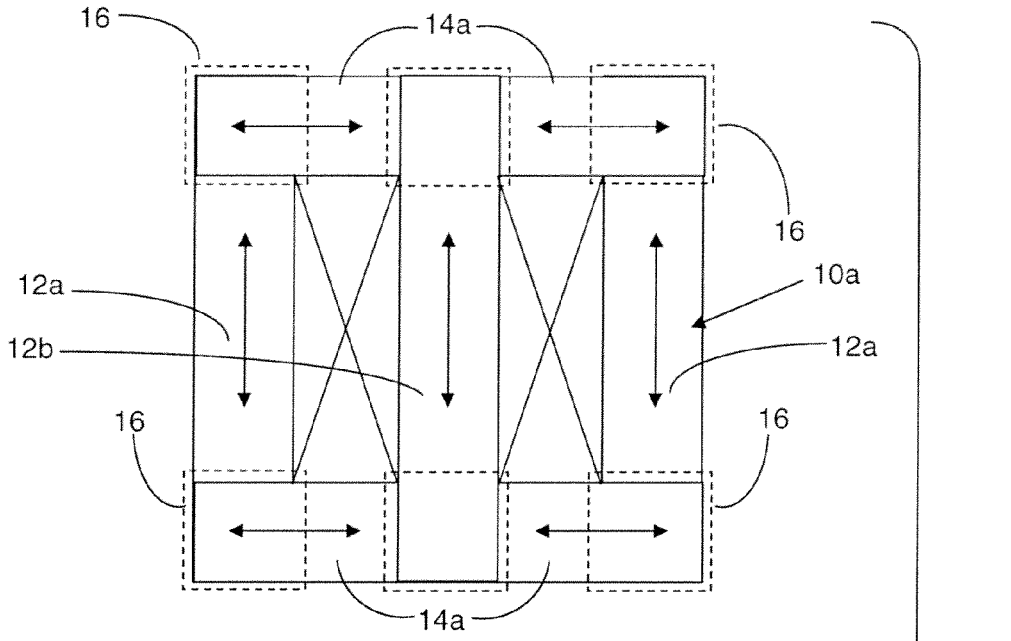
Fig. 1A PRIOR ART
FIGS. 1A and 1B are schematic views showing layers of laminates in a prior art three-phase grain-oriented steel core for an electromagnetic device.
Figure 1B:
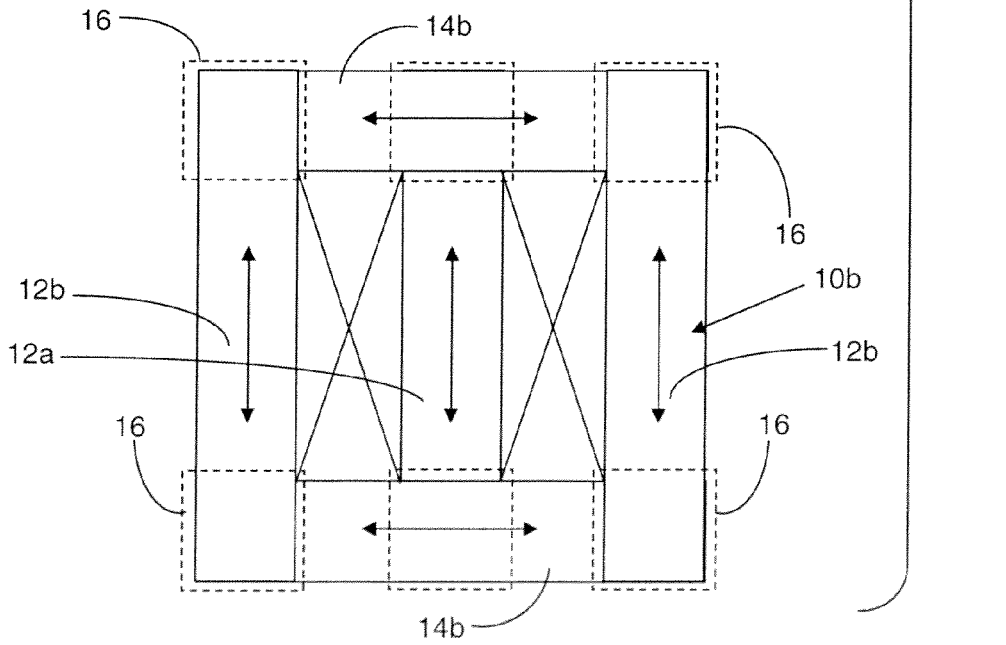
Fig. 1B PRIOR ART

A magnetic core for an electromagnetic device comprises a plurality of core elements, including legs 12 and yokes 14 arranged quadrature to the legs 12. FIGS. 1A and 1B illustrate typical alternating layers 10*a*, 10*b* in a prior art interleaved magnetic core for an electromagnetic device, such as (without limitation) a transformer or reactor. As is well known to those skilled in the art, an interleaved-type laminated magnetic core comprises a series of interleaved laminate layers 10*a*, 10*b* of steel laminations. Each laminate layer 10*a* or 10*b* may be formed from one laminate of sheet steel or from multiple laminates of sheet steel, depending on design parameters and the gauge of the steel. A typical magnetic core may for example have three 0.014 inch thick steel laminates in each laminate layer 10*a*, 10*b*. In the embodiment illustrated, the core would alternate between the layers 10*a* and 10*b*, in interleaved fashion, to achieve the desired core thickness. As is well known, in this type of magnetic core the joints between core elements are located in different parts of the layers 10*a*, 10*b*, so that in the assembled core with the layers 10*a*, 10*b* interleaved there is no intentional gap between the core legs 12 (formed from alternating leg components 12*a*, 12*b*) and the yokes 14 (formed from alternating yoke components 14*a*, 14*b*), which would increase the magnetic reluctance of the core.

Figure 2:
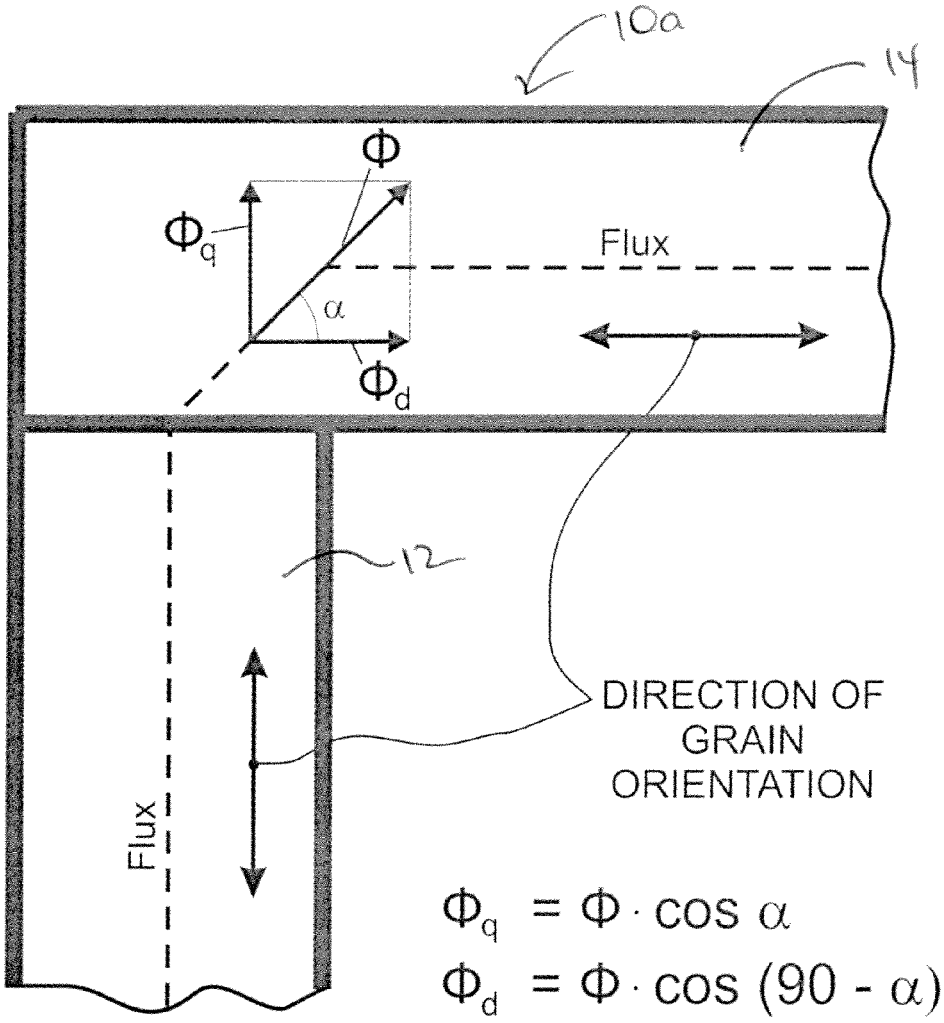
FIG. 2 is a schematic view illustrating a typical flux distribution in the corner of the prior art grain-oriented steel core composed of the layers of laminates in FIGS. 1A and 1B.

FIG. 2 is a partial schematic view showing the layer 10*a* of the prior art laminated grain-oriented steel core of FIGS. 1A and 1B. In the simple case illustrated, the width of the core leg 12 and the width of the yoke 14 being equal, angle α32 45 degrees. It will be appreciated by those skilled in the art that the magnetic flux in the core 10 actually changes direction in a less abrupt and more chaotic pattern, and the 45 degree angle shown is an approximation for purposes of illustration only.

The flux passing through the portions of the layer 10 where the legs 12 and yokes 14 abut, hereinafter referred to as the "flux deflection zones" 16 (i.e. those regions where the flux changes direction in the core), can be represented by two components: a direct component Φd (as shown, in the direction of the yoke 14), and a quadrature component Φq (as shown, in the direction of the leg 12). Because the yoke 14 overlaps the leg 12 in the layer 10*a*, the direct component of the flux Φd is flowing along the grain orientation and the quadrature component of the flux Φq is flowing across the grain orientation.

Power losses created by the flow of the direct component of the flux Φd are defined in losses per pound, as specified by the steel manufacturer. However, the power losses created by the flow of quadrature component of the flux Φq, because it is flowing quadrature to grains in the steel, are much higher than nominal power losses created by the flow of the direct component of the flux Φd, which flows in the direction of the grains in the steel. For example, in M6 type grain-oriented steel, power losses created by the flow of quadrature component of the flux Φq are approximately three times higher than power losses created by the flow of the direct component of the flux Φd flowing in the direction of the grain.

Figure 3A:
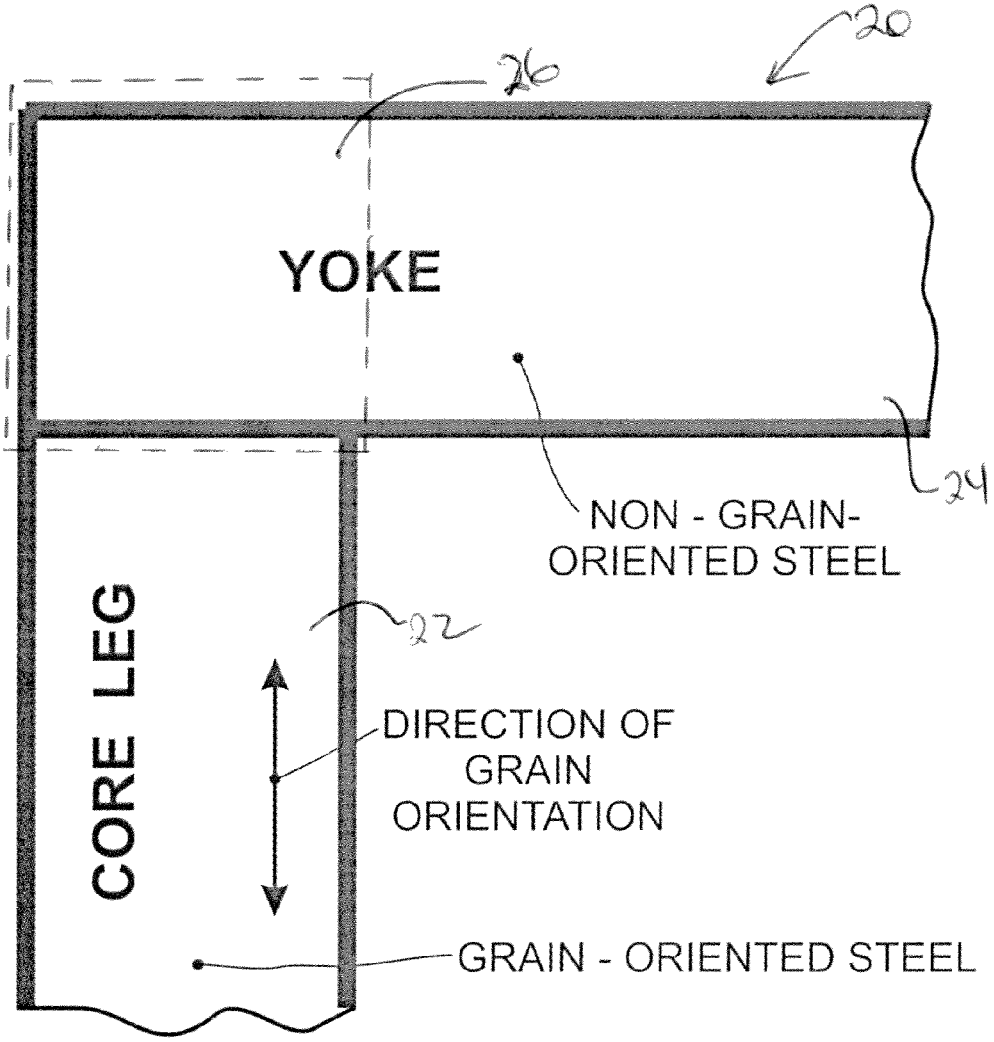
FIG. 3A is a schematic view of a butt gap magnetic core according to the invention, having core legs made of grain-oriented steel and yokes made of non-grain-oriented steel.

FIG. 3A illustrates a corner of a butt gap core 20 according to the invention, wherein the core legs 22 are formed entirely from grain-oriented steel and the yokes 24 are formed entirely from non-grain-oriented steel. This type of core is formed from identical layers, thus creating a joint between the legs 12 and the yokes 14. The legs 22 are formed from grain-oriented steel while the yokes 24 are formed from non-grain-oriented steel. In such a core design the flux in the core legs 22 flows along the direction of the grain with low power losses, and flux shifting occurs in the yokes 24 which are made of non-grain-oriented steel. This design reduces core losses in the flux deflection zones 26, since the steel in the flux deflection zones 26 is non-grain-oriented steel, and also reduces the overall cost of the core because non-grain-oriented steel is substantially less expensive than grain-oriented steel. However, the use of non-grain-oriented steel in this fashion, although reducing power losses in the flux deflection zones 26 of the core 20, may increase power losses in the other parts of the core (specifically in this case, the yokes 24) because power losses are substantially greater in non-grain-oriented steel than in grain-oriented steel. Reduction of power losses from the yokes 24 may be achieved by increasing the width of each yoke 24, and the cost savings of the core 20 will still be significant, if design parameters permit this.

Figure 3B:
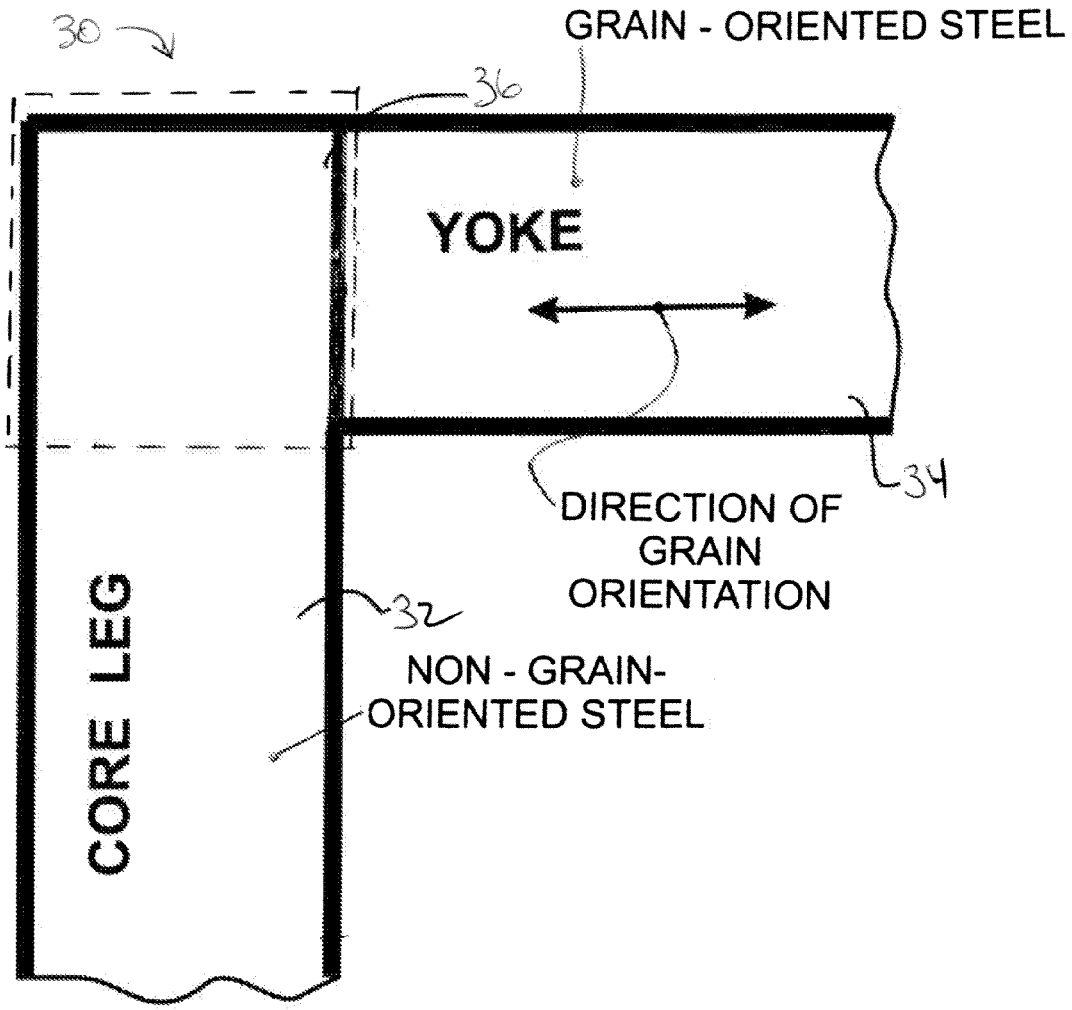
FIG. 3B is a schematic view of a butt gap magnetic core according to the invention, having yokes made of grain-oriented steel and core legs made of non-grain-oriented steel.

FIG. 3B illustrates a corner of a butt gap core 30 according to the invention, wherein the core legs 32 are formed entirely from non-grain-oriented steel and the yokes 34 are formed entirely from grain-oriented steel. In this embodiment the legs 32 overlap the ends of the yokes 34, and the flux deflection zones 36 are generally at the ends of the legs 32 which are formed from non-grain-oriented steel. The principles and operation of this embodiment are similar to those of the embodiment of FIG. 3A.

FIGS. 4 to 6 illustrate various configurations of interleaved-type laminated magnetic cores according to the invention. According to the principles of the invention, the core elements are formed from steel laminate layers, the layers being composed of a combination of grain-oriented steel and non-grain-oriented steel such that the magnetic flux flows along the steel grains of grain-oriented steel within the portions of core elements in which the flux flows substantially along the length of the core element and does not change direction; while the flux deflection zones of the core, i.e. the regions of the core in which the flow of magnetic flux changes direction from a leg to a yoke or from a yoke to a leg, are composed partly or entirely of non-grain-oriented steel. This reduces power losses in the flux deflection zones 16 between abutting core elements, because the magnetic flux is never flowing quadrature to the direction of the grain orientation in the grain-oriented steel portions of the core elements. The level of core power losses can still be controlled by changing the width of the yokes and/or changing the ratio of the cross-section areas of the grain-oriented steel and non-grain-oriented steels.

Figures 4A, 4B:
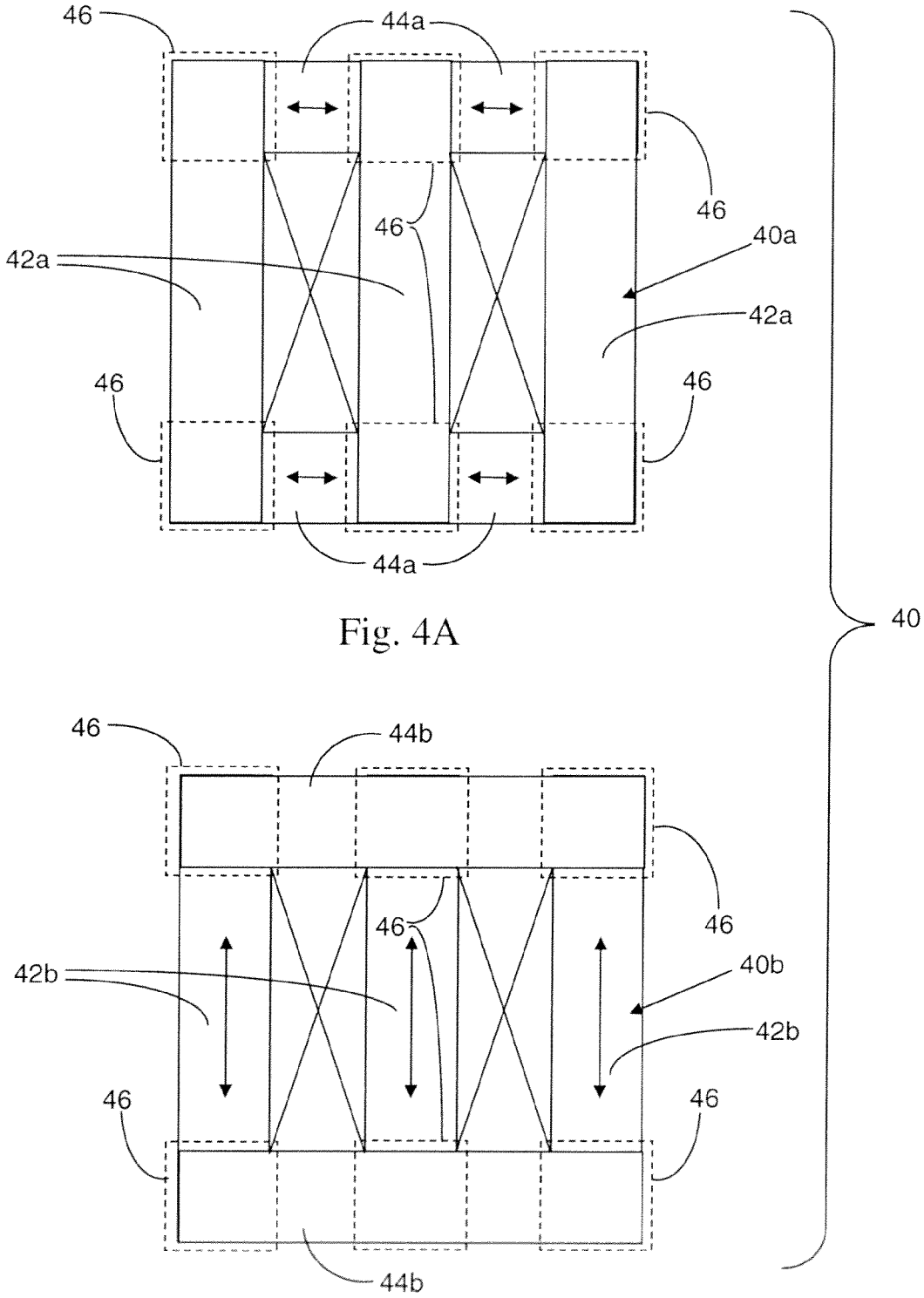
FIGS. 4A and 4B are schematic views of the layer arrangement in a first embodiment of a three-phase magnetic core for an electromagnetic device according to the invention.
Figure 4C:
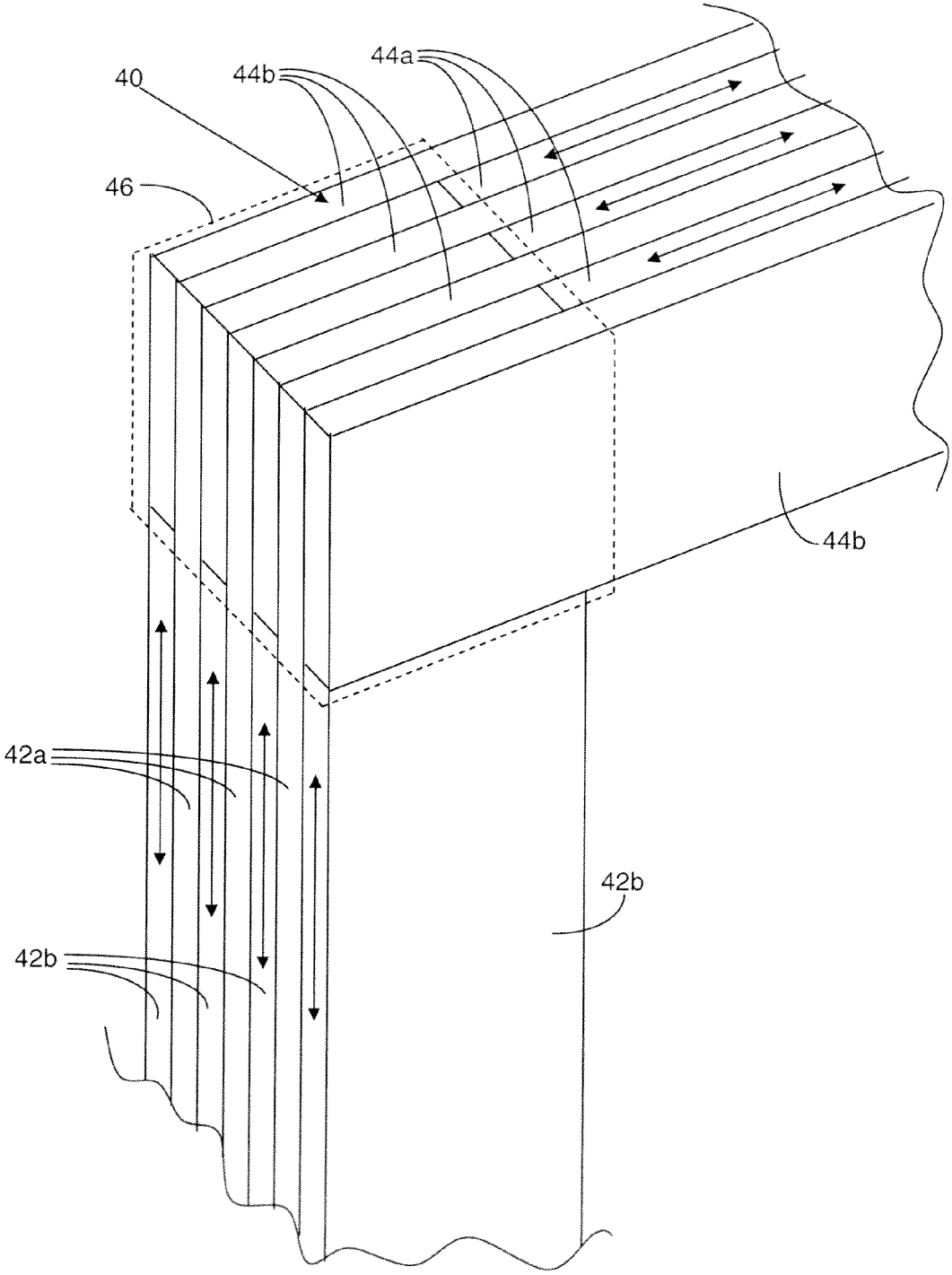
FIG. 4C is a partial perspective view of the magnetic core formed from alternate interleaving of the layers of FIGS. 4A and 4B.

In particular, FIGS. 4A and 4B respectively illustrate the two alternating interleaved laminate layers 40*a*, 40*b* in a three-phase magnetic core 40 according to the invention. The core 40 has core elements comprising legs 42*a* and 42*b* abutting yokes 44 arranged in quadrature relation to the legs 42*a* and 42*b*, as is conventional. However, in the first layer 40*a* of the two alternating layers, shown in FIG. 4A, the yokes are formed from components 44*a* composed of grain-oriented steel (as indicated by the double-headed arrows) disposed between the legs 42*a*, while the legs 42*a* of the layer 40*a* are composed entirely of non-grain-oriented steel. The flux deflection zones 46 in the layer 40*a* are disposed at the ends of the legs 42*a*, and are thus composed of non-grain-oriented steel. In the second layer 40*b* of the two alternating layers, shown in FIG. 4B, the yokes 44 are composed entirely of non-grain-oriented steel while the legs 42*b* are composed of grain-oriented steel (as indicated by the double-headed arrows) and extend between the yokes 44. The flux deflection zones in the layer 40*b* are disposed at the ends and middle portions of the yokes 44, and thus composed of non-grain-oriented steel. When multiple layers 40*a*, 40*b* are assembled into a core 40 in alternating interleaved fashion, the flux deflection zones 46 in the core 40 are entirely composed of non-grain-oriented steel, as shown in FIG. 4C.

Thus, as magnetic flux flows through the non-grain-oriented steel core legs 42 and reaches a flux deflection zone 46 of the core 40, the flux deflects toward a quadrature orientation substantially within the flux deflection zone 46, which is composed of non-grain-oriented steel, and enters the grain-oriented steel yoke components 44*a* already substantially aligned with the direction of the steel grains. This configuration is also advantageous because the longer components in the layers 40*a*, 40*b* are formed from non-grain-oriented steel, which is less expensive than grain-oriented steel, so the cost of the core 40 relative to a conventional core having substantially the same power losses is considerably less than the cost of a comparable prior art core composed entirely of grain-oriented steel, for example up to 25% less. Alternatively, the power losses in the core 40 are substantially less than the power losses in a conventional core of the same cost as the core 40.

Figure 5A:
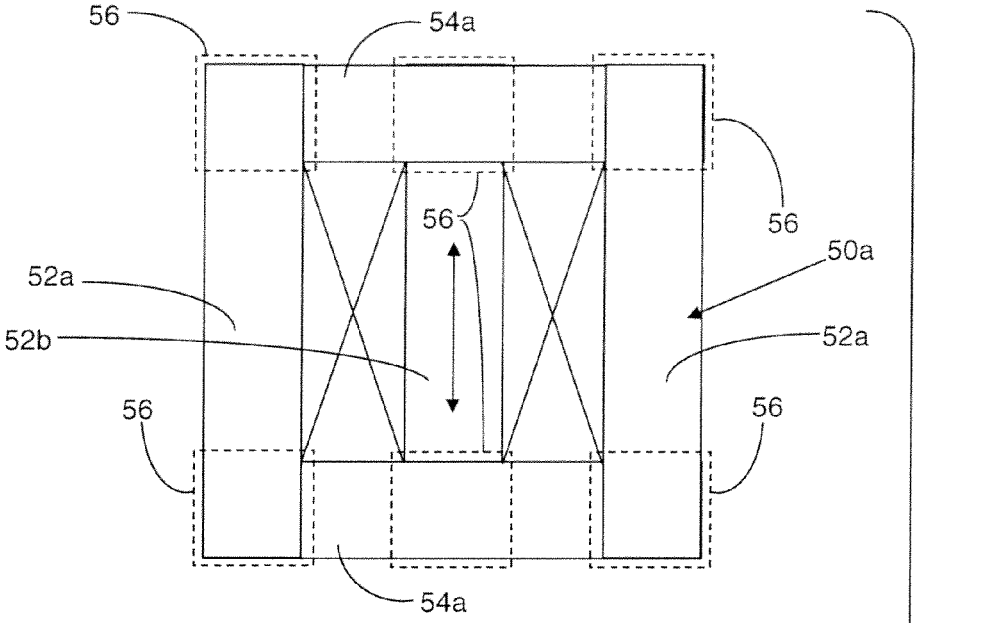
FIGS. 5A and 5B are schematic views of layer arrangement in a further embodiment of a three-phase magnetic core for an electromagnetic device according to the invention.
Figure 5B:
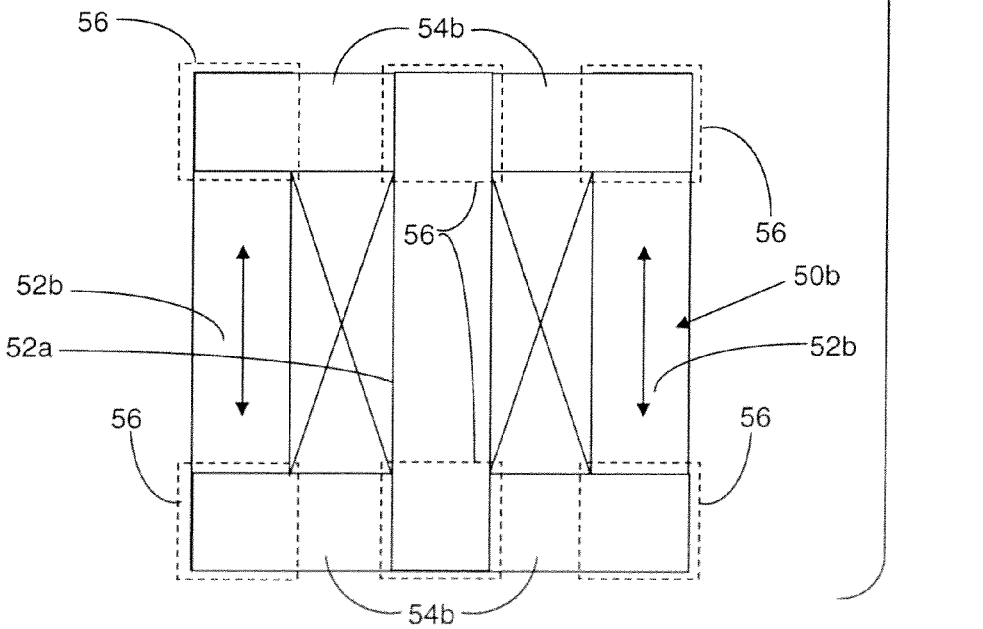

FIGS. 5A and 5B illustrate laminate layers 50*a*, 50*b* of another configuration of magnetic core 50 according to the invention. The core 50 has core elements comprising legs 52 abutting yokes 54 arranged in quadrature relation to the legs 52. In this embodiment, in the first layer 50*a* of the two alternating layers, shown in FIG. 5A, the yokes 54 are formed from non-grain-oriented steel and are disposed between the outer legs 52 which are also formed from non-grain-oriented steel. Only the middle leg 52, disposed between the yokes 54, is composed of grain-oriented steel (as indicated by the double-headed arrow). The flux deflection zones 56 in the layer 50*a* are disposed at the ends of the outer legs 52 and the middle portions of the yokes 54, which are composed of non-grain-oriented steel. In the second layer 50*b* of the two alternating layers, shown in FIG. 5B, the yokes 54 are composed of non-grain-oriented steel while the outer legs 52 are composed of grain-oriented steel (as indicated by the double-headed arrows) and extend between the yokes 54. The flux deflection zones in the layer 50*b* are disposed at the ends of the yokes 54 and the ends of the middle leg 52, and are thus composed of non-grain-oriented steel. When multiple layers 50*a*, 50*b* are assembled into a core 50 in alternating interleaved fashion, the flux deflection zones 56 in the core 50 are entirely composed of non-grain-oriented steel. The core power losses in this option are higher than in core 40, but the cost of this core 50 is substantially reduced in comparison with the cost of the core 40.

Figure 6A:
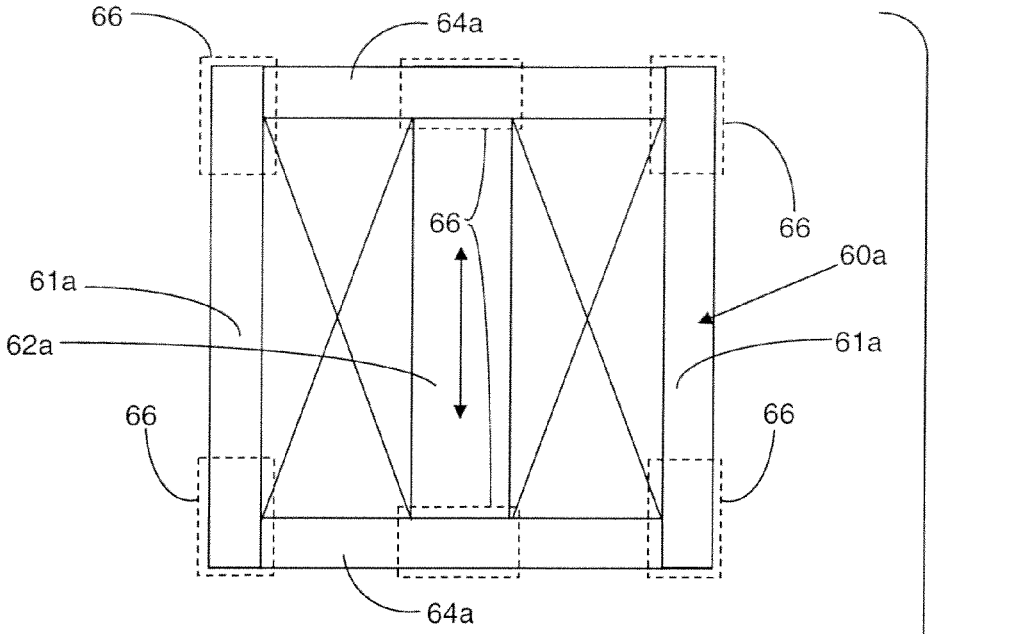
FIGS. 6A and 6B are schematic views of layer arrangement in a single-phase magnetic core for an electromagnetic device according to the invention.
Figure 6B:
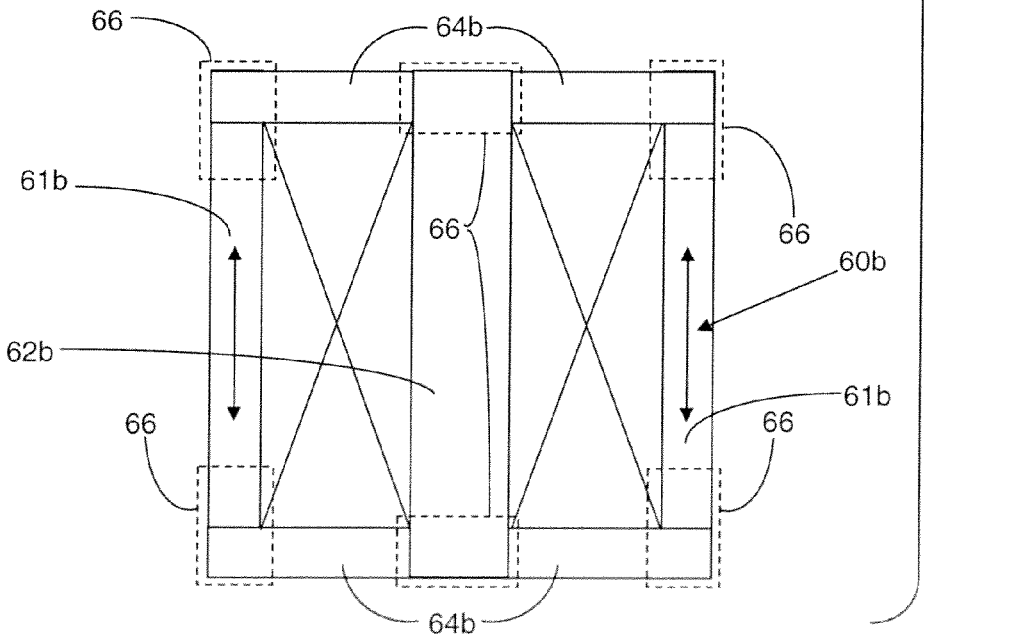

FIGS. 6A and 6B illustrate a single-phase interleaved magnetic core 60 according to the invention, with the winding on the middle core leg 62. The core 60 has core elements comprising outer legs 61 (typically one half the width of the middle leg 62) abutting yokes 64 arranged in quadrature relation to the legs 61, 62. In this embodiment, in the first layer 60*a* of the two alternating laminate layers, shown in FIG. 6A, the yokes 64*a* are formed from non-grain-oriented steel and are disposed between the outer legs 61*a* which are also formed from non-grain-oriented steel. Only the middle leg 62*a*, disposed between the yokes 64*a*, is composed of grain-oriented steel (as indicated by the double-headed arrow). The flux deflection zones 66 in the layer 60*a* are disposed at the ends of the outer legs 61*a* and the middle portions of the yokes 64*a*, which are composed of non-grain-oriented steel. In the second layer 60*b* of the two alternating layers, shown in FIG. 6B, the yokes 64 are composed of non-grain-oriented steel portions 64*b* extending between a non-grain-oriented steel middle leg 62*b*, while the outer legs 61*b* are composed of grain-oriented steel (as indicated by the double-headed arrows) and extend between the yokes 64*b*. The flux deflection zones 66 in the layer 60*b* are disposed at the ends of the yoke portions 64*b* and the ends of the middle leg 62*b*, and are thus composed of non-grain-oriented steel. When multiple layers 60*a*, 60*b* are assembled into a core 60 in alternating interleaved fashion, the flux deflection zones 66 in the core 60 are entirely composed of non-grain-oriented steel.

Figure 7A:
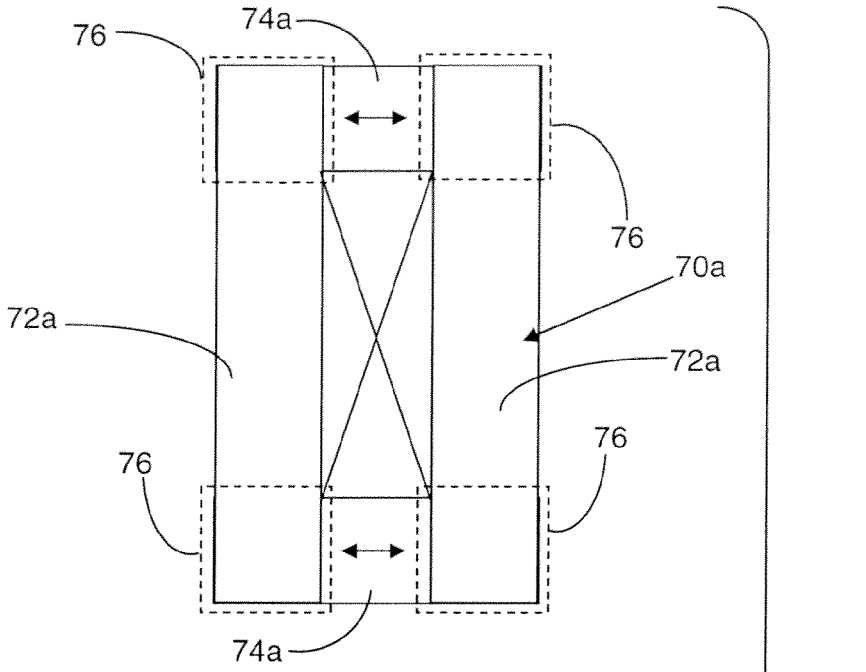
FIGS. 7A and 7B are schematic views of layer arrangement in a further embodiment of a single-phase magnetic core for an electromagnetic device according to the invention.
Figure 7B:
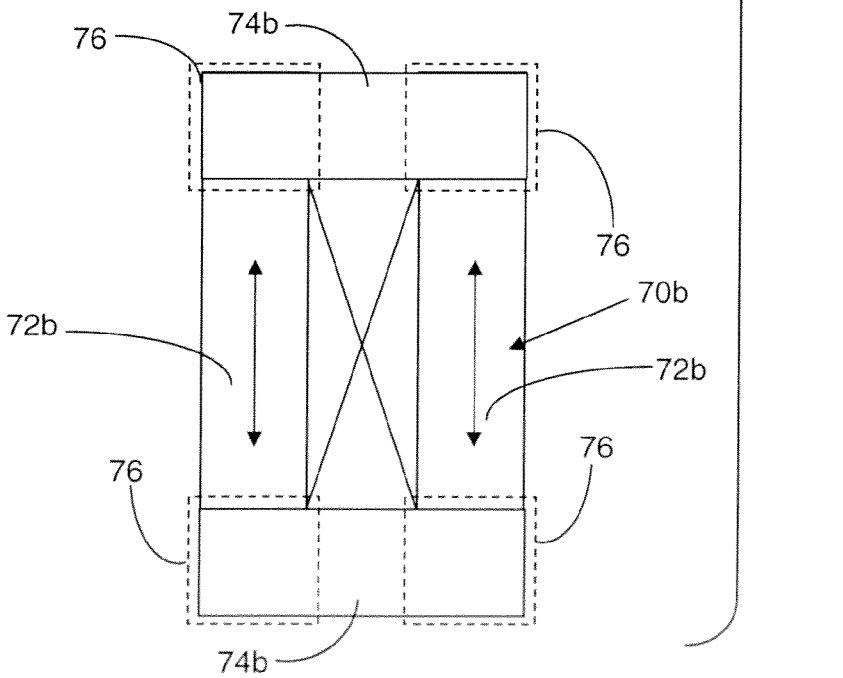

FIGS. 7A and 7B illustrate a single-phase interleaved magnetic core 70 according to the invention, with windings on one or preferably both outer core legs 72. The core 70 has core elements comprising legs 72 abutting yokes 74 arranged in quadrature relation to the legs 72. In this embodiment, in the first layer 70*a* of the two alternating layers, shown in FIG. 7A, the yokes 74 are formed from grain-oriented steel (as indicated by the double-headed arrows) and are disposed between the legs 72 which are formed from non-grain-oriented steel. The flux deflection zones 76 in the layer 70*a* are disposed at the ends of the legs 72 which are composed of non-grain-oriented steel. In the second layer 70*b* of the two alternating layers, shown in FIG. 7B, the yokes 74 are composed of non-grain-oriented steel, while the legs 72 are composed of grain-oriented steel (as indicated by the double-headed arrows) and extend between the yokes 74. The flux deflection zones 76 in the layer 70*b* are disposed at the ends of the yokes 74, and are thus composed of non-grain-oriented steel. When multiple layers 70*a*, 70*b* are assembled into a core 60 in alternating interleaved fashion, the flux deflection zones 76 in the core 70 are entirely composed of non-grain-oriented steel.

The invention thus covers both butt gap core and interleaved core designs. It will be appreciated that the principles of the invention will apply to reduce power losses at a reduced cost even if some, but not all, of the flux deflection zones 16 are composed entirely of non-grain-oriented steel.

Various embodiments of the present invention having been thus described in detail by way of example, it will be apparent to those skilled in the art that variations and modifications may be made without departing from the invention. The invention includes all such variations and modifications as fall within the scope of the appended claims.

We claim:

1. For an electromagnetic device, a magnetic core formed from steel laminations, comprising a plurality of core elements, comprising at least two legs, at least two yokes, the yokes being oriented substantially quadrature to the legs, such that abutting core elements are in substantially quadrature relation, a plurality of flux deflection zones defined in regions where flux flows from one core element to an abutting core element, the legs being formed from alternating interleaved laminate layers, at least one of the layers being composed of grain-oriented steel, and the remaining layers of the core elements being composed of non-grain-oriented steel, such that a plurality of flux deflection zones are each composed substantially of non- grain-oriented steel layers from a leg extending substantially over an entire region where the flux changes direction in the core interleaved with non-grain-oriented steel layers from a yoke extending substantially over the entire region where the flux changes direction in the core, the plurality of flux deflection zones thereby being composed substantially of non-grain-oriented steel, whereby flux flowing in a direction of a grain orientation in the at least one layer composed of grain-oriented steel changes direction to flow through the abutting core element in the flux deflection zone composed of non-grain-oriented steel.

2. The magnetic core of claim 1 wherein all flux deflection zones are composed substantially entirely of non-grain-oriented steel.

3. The magnetic core of claim 1 wherein the core is a butt gap core.

4. The magnetic core of claim 3 wherein at least one core leg is formed from grain-oriented steel and the yokes are formed from non-grain-oriented steel.

5. The magnetic core of claim 3 wherein the yokes are formed from grain-oriented steel and at least one core leg is formed from non-grain-oriented steel.

6. The magnetic core of claim 1 wherein in a first layer grain-oriented steel yokes extend between non-grain-oriented steel legs, and in a second layer grain-oriented steel legs extend between non-grain-oriented steel yokes.

7. The magnetic core of claim 6 having three legs, wherein in the first layer the yokes comprise grain-oriented steel yoke portions extending between each outer leg and a middle leg.

8. The magnetic core of claim 1 wherein in a first layer non-grain-oriented steel yokes extend between non-grain-oriented steel outer legs and a grain-oriented steel middle leg extends between the yokes, and in a second layer grain-oriented steel outer legs extends between non-grain-oriented steel yokes portions abutting a middle leg.

9. The magnetic core of claim 8 for a single phase electromagnetic device, wherein a width of the middle leg is substantially larger than a width of the outer legs.

10. The magnetic core of claim 8 having three legs, wherein a width of the middle leg is substantially the same as a width of the outer legs.

11. An electromagnetic device, comprising a magnetic core formed from steel laminations, and at least one winding wound over the core, the magnetic core comprising a plurality of core elements, comprising at least two legs, at least two yokes, the yokes being oriented substantially quadrature to the legs, such that abutting core elements are in substantially quadrature relation, a plurality of flux deflection zones defined in regions where flux flows from one core element to an abutting core element, the legs being formed from alternating interleaved laminate layers, at least one of the layers being composed of grain-oriented steel, and the remaining layers of the core elements being composed of non-grain-oriented steel, such that a plurality of flux deflection zones are each composed substantially of non-grain-oriented steel layers from a leg extending substantially over an entire region where the flux changes direction in the core, interleaved with non-grain-oriented steel layers from a yoke extending substantially over the entire region where the flux changes direction in the core the plurality of flux deflection zones thereby being composed substantially of non-grain-oriented steel, whereby flux flowing in a direction of a grain orientation in the at least layer composed of grain-oriented steel changes direction to flow through the abutting core element in the flux deflection zone composed of non-grain- oriented steel.

12. The electromagnetic device of claim 11 wherein all flux deflection zones are composed substantially entirely of non-grain-oriented steel.

13. The electromagnetic device of claim 11 wherein the core is a butt gap core.

14. The electromagnetic device of claim 13 wherein at least one core leg is formed from grain-oriented steel and the yokes are formed from non-grain-oriented steel.

15. The electromagnetic device of claim 13 wherein the yokes are formed from grain-oriented steel and at least one core leg is formed from non-grain-oriented steel.

16. The electromagnetic device of claim 11 wherein in a first layer grain-oriented steel yokes extend between non-grain-oriented steel legs, and in a second layer grain-oriented steel legs extends between non-grain-oriented steel yokes.

17. The electromagnetic device of claim 16 having three legs, wherein in the first layer the yokes comprise grain-oriented steel yoke portions extending between each outer leg and a middle leg.

18. The electromagnetic device of claim 11 wherein in a first layer non-grain-oriented steel yokes extend between non-grain-oriented steel outer legs and a grain-oriented steel middle leg extends between the yokes, and in a second layer grain-oriented steel outer legs extends between non-grain-oriented steel yokes portions abutting a middle leg.

19. The electromagnetic device of claim 18 for a single phase electromagnetic device, wherein a width of the middle leg is substantially larger than a width of the outer legs.

20. The electromagnetic device of claim 18 having three legs, wherein a width of the middle leg is substantially the same as a width of the outer legs.

* * * * *